US008381452B1

(12) United States Patent
Forsland et al.

(10) Patent No.: US 8,381,452 B1
(45) Date of Patent: Feb. 26, 2013

(54) STRUCTURE HAVING A CONVERTIBLE ROOF AND SIDEWALL

(75) Inventors: Kent Harry Forsland, River Falls, WI (US); Elav William Anderson, Menominee, WI (US)

(73) Assignee: Cabreeco Companies LLC, River Falls, WI (US)

( * ) Notice: Subject to any disclaimer, the term of this patent is extended or adjusted under 35 U.S.C. 154(b) by 0 days.

(21) Appl. No.: 13/043,162

(22) Filed: Mar. 8, 2011

Related U.S. Application Data

(60) Provisional application No. 61/339,690, filed on Mar. 8, 2010.

(51) Int. Cl.
*E04B 1/346* (2006.01)

(52) U.S. Cl. ..... 52/66; 52/64; 4/494

(58) Field of Classification Search ..... 52/64, 66, 52/67; 4/494
See application file for complete search history.

(56) References Cited

U.S. PATENT DOCUMENTS

| | | | |
|---|---|---|---|
| 1,896,433 | A | 2/1933 | Windeknecht |
| 2,229,908 | A | 1/1941 | Wenneborg |
| 2,895,183 | A | 7/1959 | Dumbolton |
| 3,028,872 | A | 4/1962 | Cresswell |
| 3,093,834 | A | 6/1963 | Watkins |
| 3,248,830 | A | 5/1966 | Maynard |
| 3,443,265 | A | 5/1969 | Hauck |
| 3,462,891 | A | 8/1969 | Smith |
| 3,566,555 | A | 3/1971 | Schultz et al. |
| 3,662,410 | A | 5/1972 | Lankheet |
| 3,766,691 | A | 10/1973 | Ray |
| 3,845,591 | A | 11/1974 | Stine |
| 4,175,361 | A | 11/1979 | Kumode |
| 4,245,614 | A | 1/1981 | Hurwitz et al. |
| 4,271,644 | A | 6/1981 | Rilliet |
| 4,283,889 | A | 8/1981 | Dunn |
| 4,312,157 | A | 1/1982 | Hertel et al. |
| 4,426,744 | A | 1/1984 | Love |
| 4,532,743 | A | 8/1985 | Miller et al. |
| 4,633,626 | A | 1/1987 | Freeman et al. |
| 4,674,241 | A | 6/1987 | Sarrazin |
| 4,683,686 | A | 8/1987 | Ozdemir |
| 4,706,420 | A | 11/1987 | Winkler |
| 4,785,590 | A | 11/1988 | Jones |
| 4,807,312 | A | 2/1989 | Baus |
| 4,884,376 | A | 12/1989 | DeBlock et al. |
| 4,977,713 | A | 12/1990 | Zveibil |

(Continued)

FOREIGN PATENT DOCUMENTS

| | | |
|---|---|---|
| DE | 34 24 542 A1 | 1/1986 |
| FR | 2 623 550 A1 | 5/1989 |

(Continued)

OTHER PUBLICATIONS

Brochure from Libart Enclosure Systems, 12 pages (Publicly known at least as early as Jan. 2009).

(Continued)

*Primary Examiner* — Jeanette E Chapman
*Assistant Examiner* — Daniel Kenny
(74) *Attorney, Agent, or Firm* — Merchant & Gould P.C.

(57) ABSTRACT

A foundation system and a roof system are especially useful for flexible indoor/outdoor space structures. The foundation system has adjustment features for leveling of flexible structures. The roof system features independent roof segments. The foundation system includes one or more foundation members which have a frame, a base and an adjustable height member. Also disclosed are drive, connection, level sensing and control elements for the foundation system. The roof system includes a fixed bean with roller tracks, a set of overlapping roof segments, and a header beam also with roller tracks.

8 Claims, 7 Drawing Sheets

ROOF PANELS CLOSED

U.S. PATENT DOCUMENTS

| | | | |
|---|---|---|---|
| 5,156,195 | A | 10/1992 | Wehler et al. |
| 5,293,728 | A | 3/1994 | Christopher et al. |
| 5,394,660 | A | 3/1995 | Haris |
| 5,596,844 | A | 1/1997 | Kallinowski |
| 5,598,665 | A | 2/1997 | Guddas |
| 5,907,928 | A | 6/1999 | Charbonnel |
| 6,003,279 | A | 12/1999 | Schneider |
| 6,332,645 | B1 | 12/2001 | Schwarz |
| 6,430,879 | B1 | 8/2002 | Nuiry et al. |
| 6,474,027 | B2 | 11/2002 | Nelson |
| 6,591,557 | B1 | 7/2003 | Thomsen et al. |
| 6,604,327 | B1 | 8/2003 | Reville |
| 6,637,160 | B2 | 10/2003 | Brooks |
| 7,263,805 | B2 | 9/2007 | Chapus |
| 7,469,506 | B2 | 12/2008 | Hosey |
| 7,748,429 | B2 | 7/2010 | Caire et al. |
| 7,752,815 | B2 | 7/2010 | Lauria et al. |
| 7,762,900 | B2 | 7/2010 | Henry et al. |
| 2002/0032993 | A1 | 3/2002 | Nelson |
| 2003/0000154 | A1 | 1/2003 | Ignazio |
| 2003/0014927 | A1 | 1/2003 | Brooks |
| 2004/0187397 | A1 | 9/2004 | Chapus |
| 2009/0107061 | A1 | 4/2009 | Guthrie |
| 2009/0300997 | A1 | 12/2009 | Scheps |
| 2011/0308173 | A1 | 12/2011 | Forsland et al. |
| 2012/0000141 | A1 | 1/2012 | Forsland et al. |

FOREIGN PATENT DOCUMENTS

| | | | |
|---|---|---|---|
| FR | 2 866 379 | A1 | 8/2005 |
| GB | 2 097 849 | A | 11/1982 |
| GB | 2 135 372 | A | 8/1984 |
| GB | 2 414 251 | A | 11/2005 |
| JP | 4-203061 | | 7/1992 |
| JP | 5-231071 | | 9/1993 |
| JP | 2003-293457 | | 10/2003 |
| NL | 9500387 | | 10/1996 |

OTHER PUBLICATIONS

Brochure from Roll-A-Cover, International, 8 pages (Publicly known at least as early as Jan. 2009).

Images from www.libart.com website, 18 pages (Date Printed Jan. 25, 2011).

TEMPORARY STRUCTURE LEVELING FOOT

INDEPENDENT ROOF SEGMENTS

FLEXIBLE OPTIONS

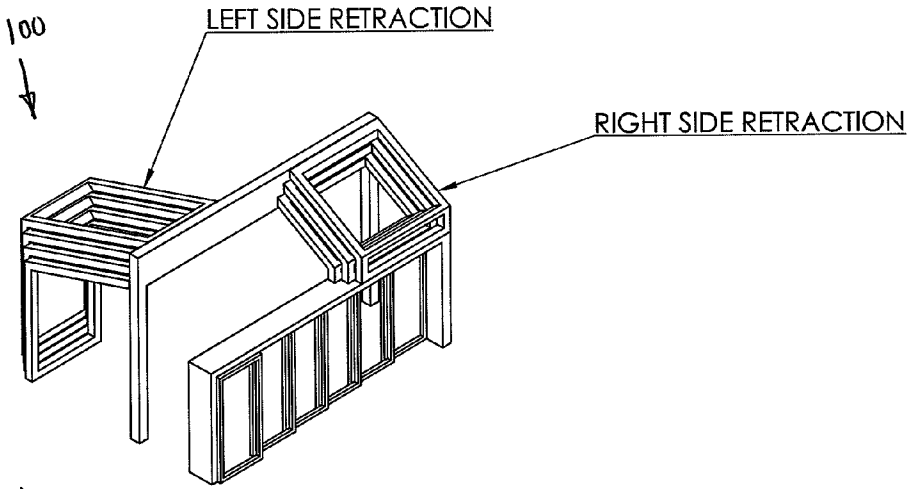
FIG. 14 ROOF PANELS OPENED
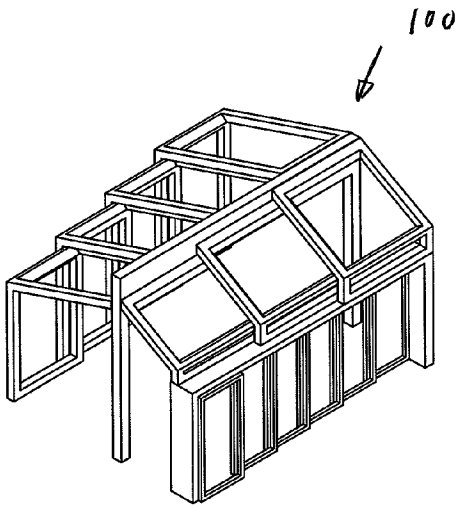
FIG. 15 ROOF PANELS CLOSED

STRUCTURE HAVING A CONVERTIBLE ROOF AND SIDEWALL

CROSS-REFERENCE TO RELATED APPLICATIONS, IF ANY

The present application claims the benefit of U.S. Provisional Patent Application Ser. No. 61/339,690, filed Mar. 8, 2010, and entitled "Flexible Space Technologies, which application is hereby incorporated by reference in its entirety.

BACKGROUND OF THE INVENTION

1. Field of the Invention

The present invention relates, generally, to building systems, apparatus and methods. Particularly, the invention relates to flexible indoor/outdoor space structures, and foundations, roofs, framing, segments, walls, and windows therefor. Most particularly, the invention relates to (1) a foundation system for a flexible indoor/outdoor space structure, and (2) a roof system for a flexible indoor/outdoor space structure.

2. Background Information

Existing technology in this field is believed to have significant limitations and shortcomings. For this and other reasons, a need exists for the present invention.

All US patents and patent applications, and all other published documents mentioned anywhere in this application are incorporated by reference in their entirety.

BRIEF SUMMARY OF THE INVENTION

The invention provides a foundation system and a roof system (and elements, assemblies and sub-assemblies thereof) for a building (particularly a flexible indoor/outdoor space structure) which are practical, reliable, and efficient, and which are believed to fulfill needs and to constitute improvements over the background technology. The invention also provides methods of using and making the foundation and roof systems, and the elements, assemblies and sub-assemblies thereof.

The foundation system of the invention has adjustment features for leveling of flexible structures The foundation system includes one or more foundation members, each of which have a frame, a base and an adjustable height member. The system also includes optional drive, connection, level sensing and control elements.

The roof system features independent roof segments. The roof system includes a fixed beam with roller tracks, a set of overlapping roof segments, and a header beam also with roller tracks.

The aspects, features, advantages, benefits and objects of the invention will become clear to those skilled in the art by reference to the following description, claims and drawings.

BRIEF DESCRIPTION OF THE SEVERAL VIEWS OF THE DRAWING

FIG. 14 is a perspective view of the independent roof segment system showing the roof panels thereof in an open state.

FIG. 15 is a perspective view of the independent roof segment system showing the roof panels thereof in a closed state.

DETAILED DESCRIPTION

The invention includes a foundation and a roof system which are especially useful for flexible indoor/outdoor space structures. The foundation and roof systems are also useable with other building structures. The foundation system has adjustment features for leveling of flexible structures. The roof system features independent roof segments.

FIGS. 1-4 show an embodiment of a foundation member 10 of the invention, which is useable in an embodiment of a foundation system (shown later) of the invention. The member 10 and foundation system are optimized for use with a building or structure such as a conservatory or conservatory-like flexible indoor/outdoor structure. The foundation system is also useable with other building structures including, but not limited to, a shop, home, garage, shed, gazebo, patio, lean-to, pavilion or the like. The building may be commercial, residential, municipal or industrial. The building may be permanent, but is preferably temporary insofar as it does not have a permanent, fixed, traditional foundation. The foundation system of the present invention is intended to be configurable and adjustable, and to move as the earth, ground or substrate upon which it is deployed may move due to seasonal or other environmental factors. In certain embodiments, the foundations disclosed herein can be used with structures of the type disclosed at U.S. patent application Ser. No. 13/041,237, filed Mar. 4, 2011 and entitled Convertible Enclosure, the contents of such application hereby being incorporated by reference in its entirety.

Figure 1:
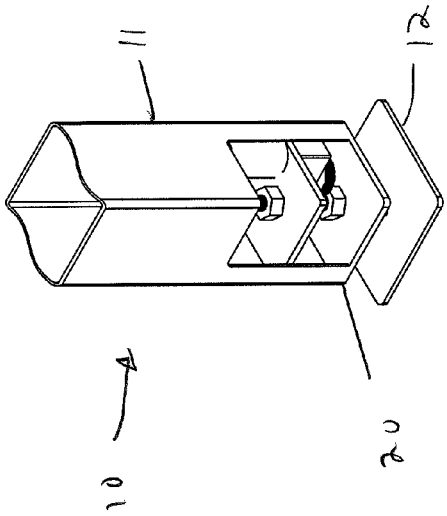
FIG. 1 is a perspective view of an embodiment of a structural element of the foundation system of the present invention.
Figure 2:
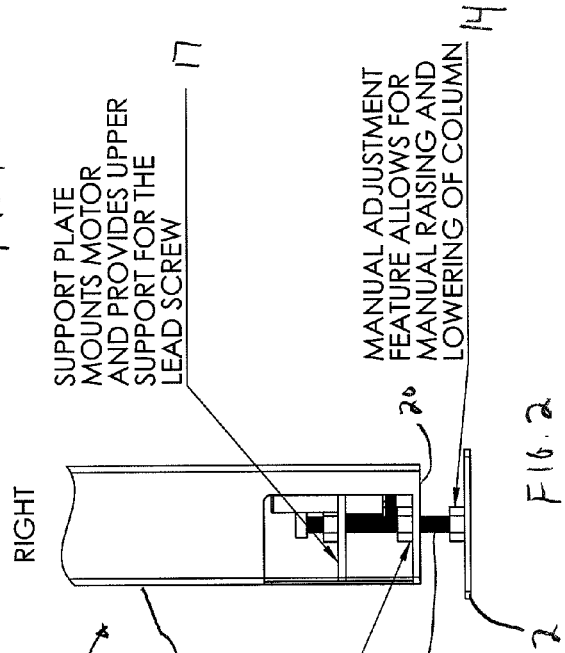
FIG. 2 is a side view of the structural element.
Figure 3:
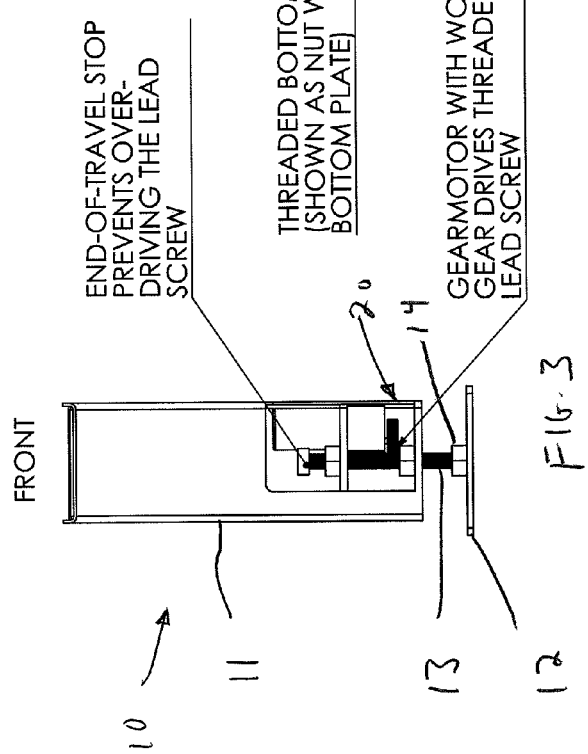
FIG. 3 is a front view of the structural element.
Figure 4:
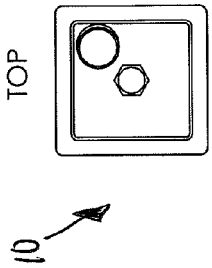
FIG. 4 is a top view of the structural element.
Figure 5:
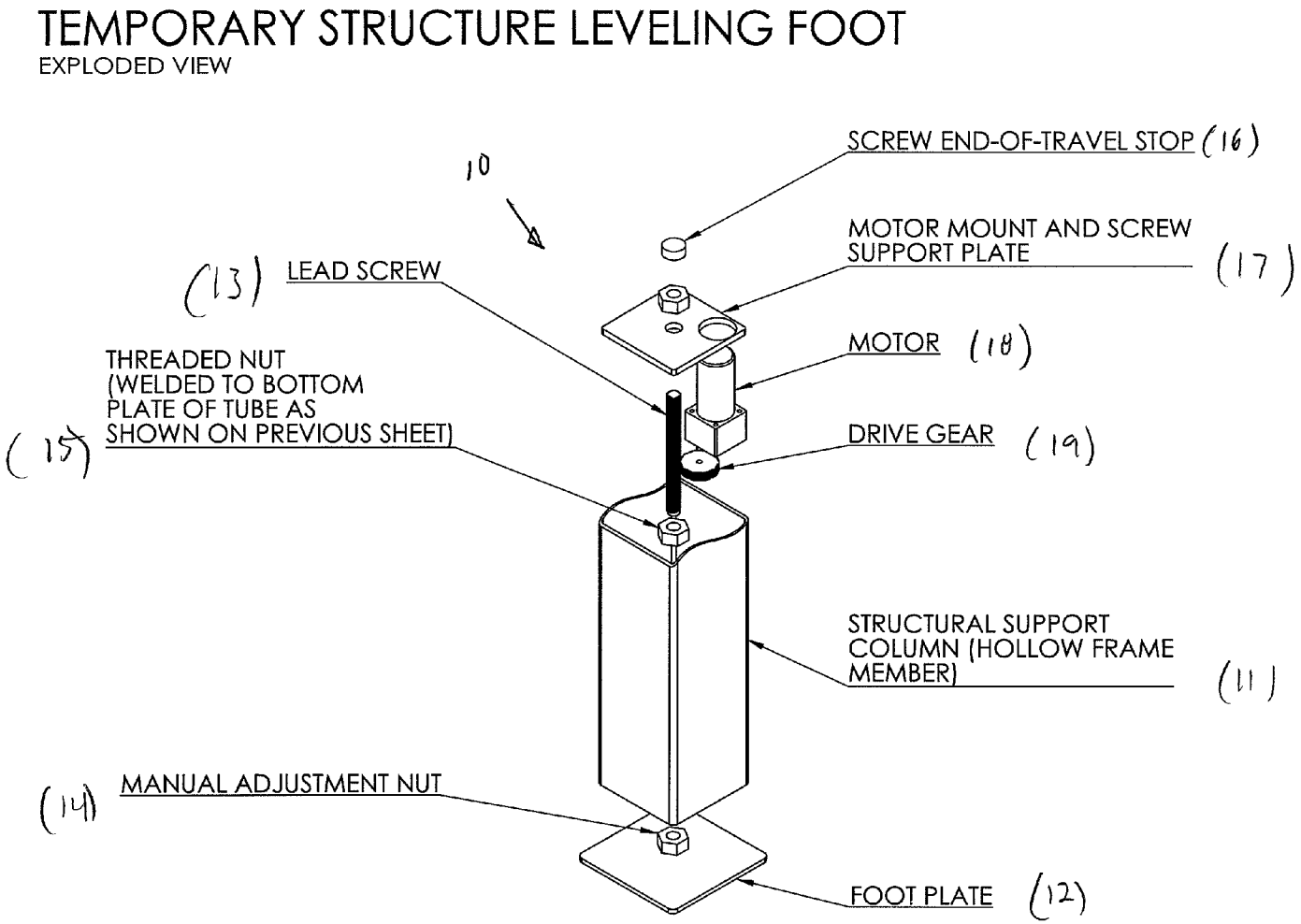
FIG. 5 is an exploded view of the structural element.
Figures 6, 7:
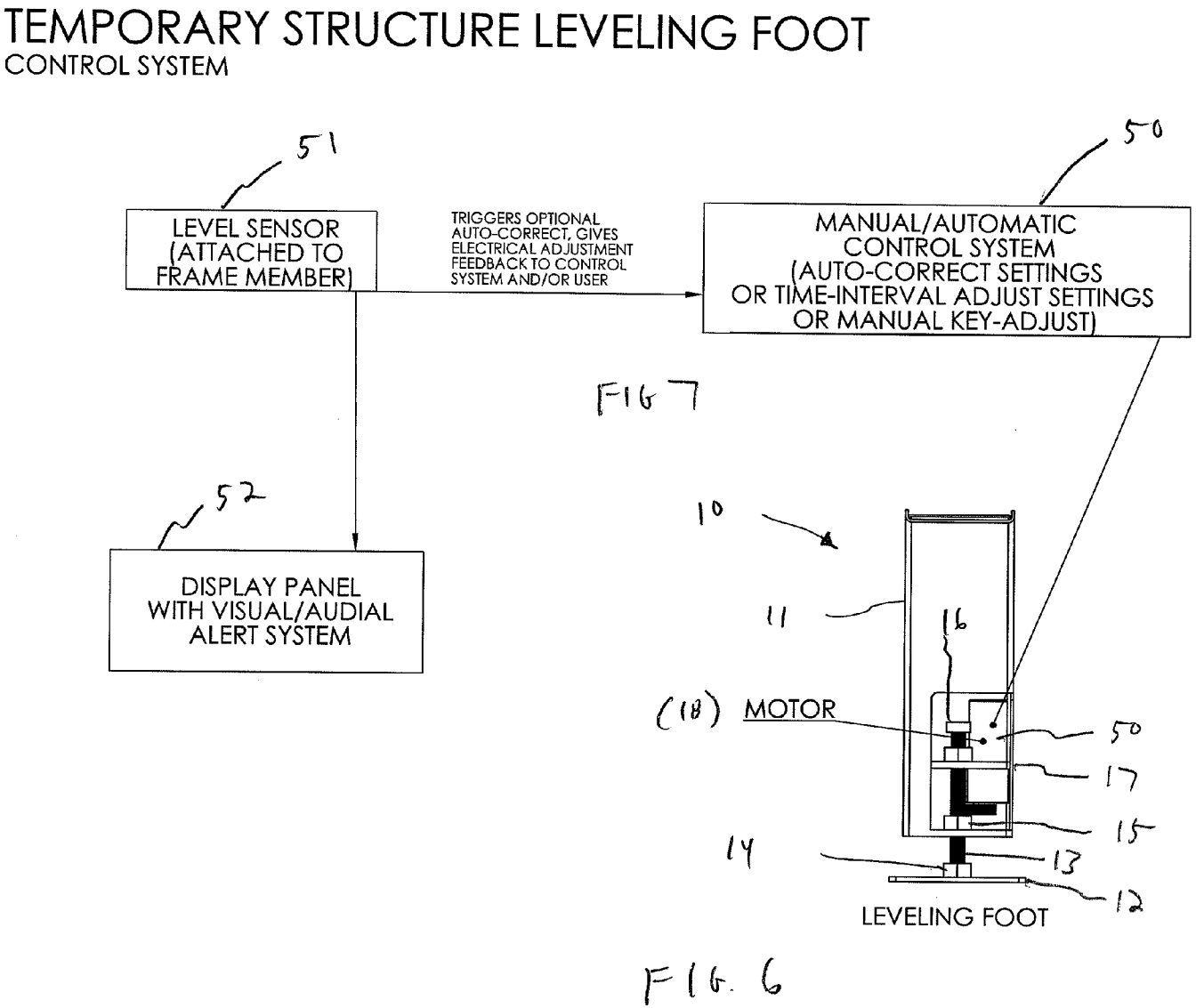
FIG. 6 is a further view of the structural element, including an embodiment of a control system therefor.
FIG. 7 is a schematic of the control system.

Referring also to FIGS. 5 and 6, the foundation member (or element or assembly) 10 basically comprises a frame 11, a foot 12, and a moveable connection member 13. Each of these elements is preferably constructed of a strong, rigid material such as steel or another metal. The frame 11 is preferably a beam or column oriented vertically. The foot 12 is preferably a plate of a predetermined area and thickness which is disposed on the earth, ground or a substrate. The moveable connection member 13 moveably connects the frame 11 to the foot 12 and permits adjustment of the distance between the two. Preferably, the member 13 is a screw structure which is vertically oriented and has a predetermined length, pitch and diameter. The bottom end of the screw 13 is connected to the foot 12 (e.g., by a swivel). A manual adjustment member 14 is disposed at the base of the screw 13 to permit rotation of it via a tool such as a wrench. The top end of screw 13 is rotatably coupled to a support member 17 which is fixed to the frame 11. Rotation of the screw 13 relative to the support member causes the frame to move vertically up or down to adjust the distance between it and the foot 12. Preferably, the frame 11 has a bottom plate member 20 with an aperture and threaded nut 15 which the screw 13 threadedly extends through. The member 10 also preferably has a travel stop member 16 disposed at the top end of the screw to limit the height of the member 10.

The member 10 is preferably powered and has a motor 18 and drive system 19 for rotating the screw 13 and adjusting the vertical height of the frame 11. FIG. 7 shows an embodiment of a control system 50 for use with the powered member 10. The control system 50 is communicatively connected to the motor 18 and to a level sensor 51. The level sensor 51 may be a single element such as a bubble type sensor or several elements. It is within the purview of the invention that the sensor 51 may be mechanical, electrical, optical, magnetic, capacitive or the like. The control system 50 is also preferably connected to a display and/or alert element or system 52. The control system 50 may be automatic, manual or a combination thereof. It is shown to have auto-correct settings, or time-interval adjust settings, manual key-adjust settings. It may also have a combination of all of the above. The level sensor 51 is preferably attached a remote location an the building, such as a framing member. It triggers optional auto-correct, give electrical adjustment feedback to the control system or the user. This maybe displayed on the panel 52 visually, audibly or both, with or without additional alerts.

The foundation member 10 may be constructed as a new, dedicated, engineered building component, or may be retrofitted into an existing building element such as a beam, column, stud, header, panel, or the like. Although the foundation member 10 is shown in the form of a quadrilateral, substantially square closed beam or column having four (4) side walls enclosing a central cavity, it may also be embodied in an open beam configuration, such as an I-Beam It may also be embodied in a non-rectilinear configuration such as a cylindrical or other curvilinear configuration such as a post. The member 10 is preferably constructed and arranged to be load bearing with respect to the building or structure. It may alternatively be deployed as a non-load bearing element. The beam is preferably deployed in a corner, outer wall of the building and foundation system, but may be deployed along the length of an outer wall, or in an interior wall. As will be described further below, the number of structural members 10 in the foundation system may be varied depending upon the building structure.

Figure 8:
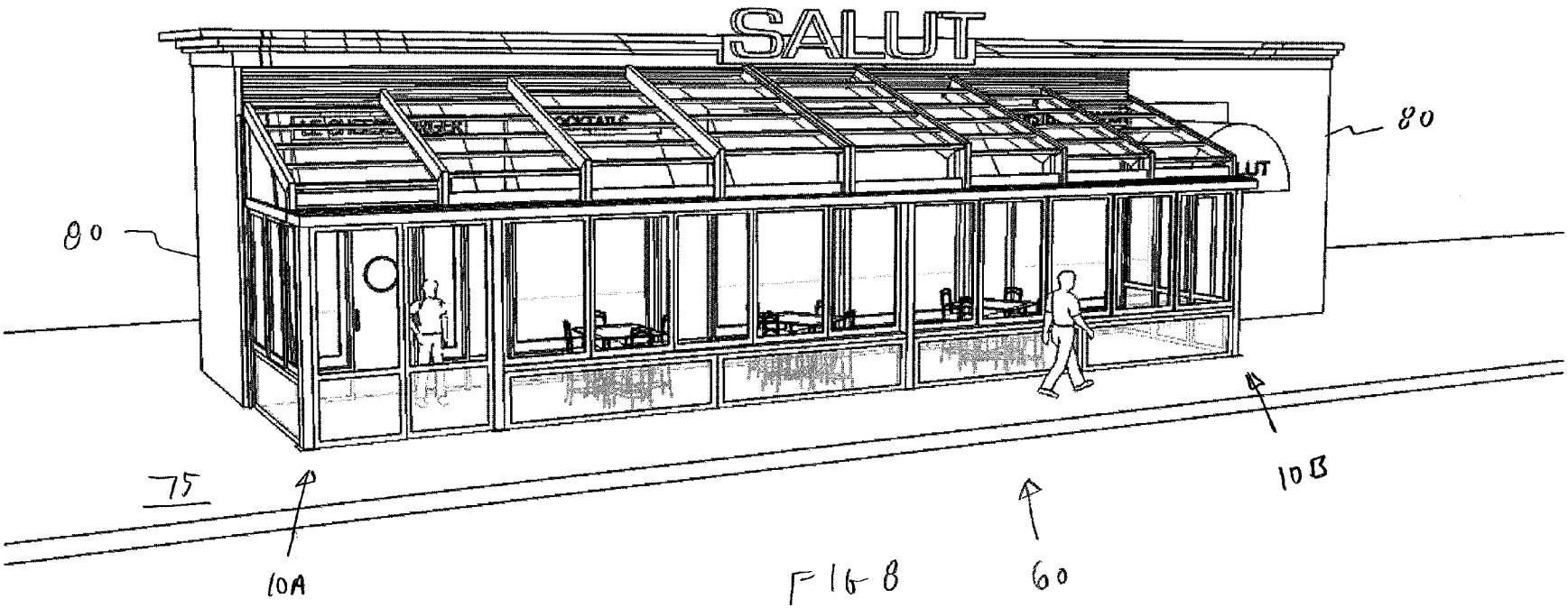
FIG. 8 is a perspective view of an embodiment of a foundation system of the invention deployed on a structure.
Figure 9:
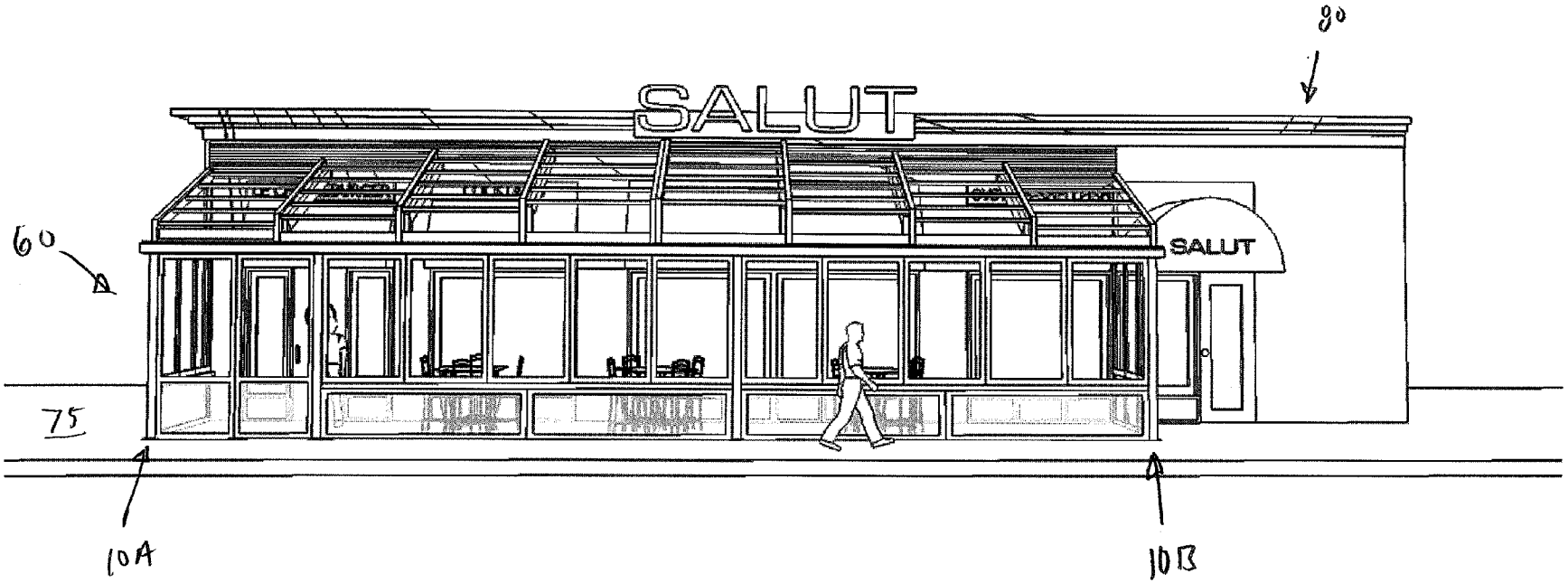
FIG. 9 is a front view of the foundation system.
Figure 10:
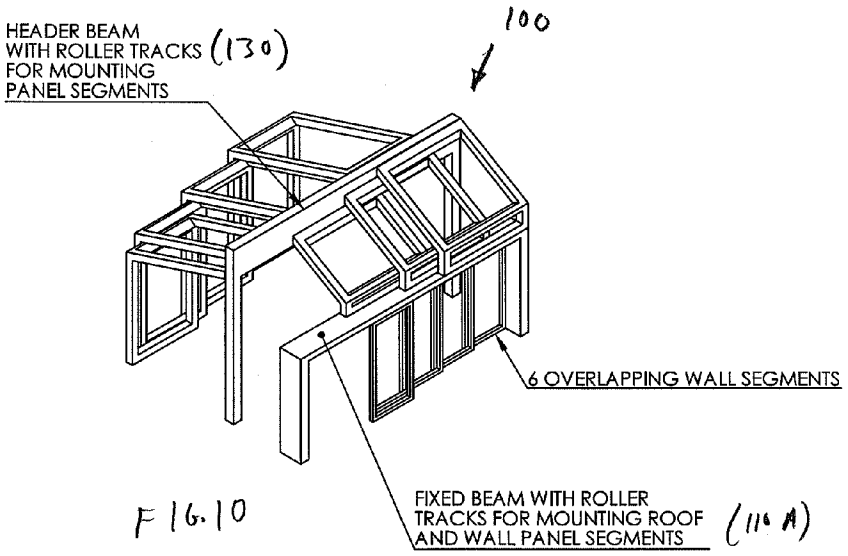
FIG. 10 is a perspective view of an embodiment of the independent roof segment system of the present invention.
Figure 11:
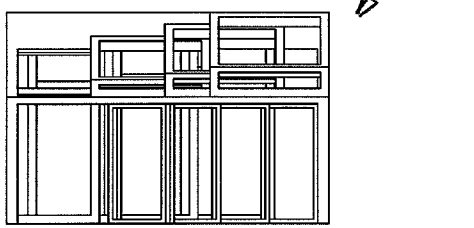
FIG. 11 is a front, elevation view of the independent roof segment system.
Figure 13:
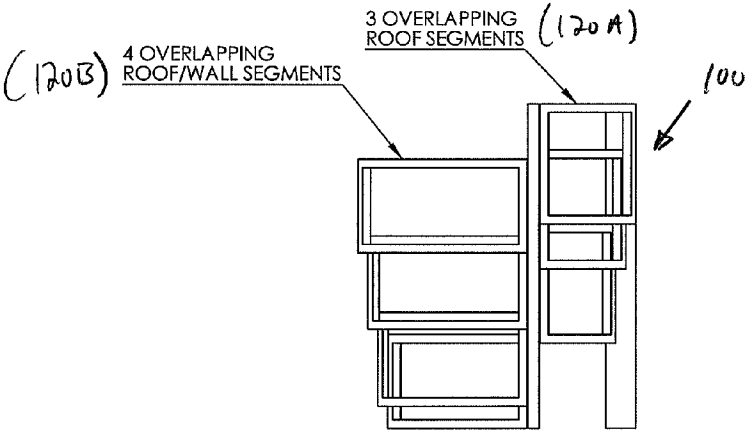
FIG. 13 is a top, plan view of a portion of the independent roof segment system.
Figure 12:
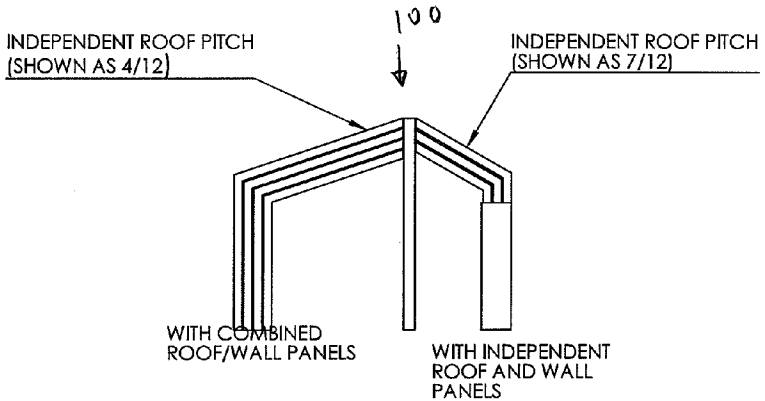
FIG. 12 is an end elevation view thereof.

FIGS. 8 and 9 show an embodiment of the foundation system 60 of the present invention. The foundation system 60 comprises at least one foundation member 10 which is connected to a building 70 either by incorporating the member 10 into the structure of the building 70 as a load bearing feature, or by affixing or connecting it to an existing load bearing feature of the building 70.

The building 70 is not affixed to ground 75. The building 70 in this embodiment is a flexible indoor/outdoor space such as one of the type manufactured and sold by Applicant's assignee, Cabreeco Companies, LLC of River Falls, Wis. USA. It is shown configured next to a permanent building 80 with a traditional foundation connected to ground/earth 75. Alternatively, the building 70 may be constructed as a stand alone unit, not associated with or connected to any other permanent building or structure.

Actuation of the member 10 as described above to adjusts it with respect to the ground or substrate (concrete, asphalt, gravel or the like on the ground) 75 upon which it is located. This in turn will adjust the building 70 as a whole with respect to the ground/substrate 75. Importantly, the member 10 is actuated at a predetermined time and at a predetermined degree so that the building 70 is leveled or maintained level. So, the member 10 is actuated for example when the ground/substrate 75 has itself moved or shifted due to environmental factors such as subsidence, shifting, heaving or the like due to seasonal or climatic changes, short term weather factors, subsurface or subterranean conditions and the like. Actuation may be manual or powered, and it may be accomplished by the user or automatically.

Preferably, the foundation system 60 comprises at least two members 10A and 10B disposed at predetermined remote, load bearing locations on the building 70, for example at two corners thereof. Also preferably, the system 60 includes at least one level sensor 51 as described above and shown in FIG. 7. Alternatively, the building may be manually leveled by user intervention by visual inspection or via the use of one or more commonly available leveling tools. Further preferably, the system 60 includes the control system described and shown above for automatic foundation adjustment based on time, sensed movement or other factors. Additional members 10 and/or sensors 51 may be added in the foundation 60 depending upon building 70 size, shape/configuration, or construction, ground/substrate 75 factors, geographical factors, climate factors and the like, FIGS. 10-15 show an embodiment of a roof system 100 of the invention. The roof system 100 is also preferably for use with a building or structure such as a conservatory or conservatory-like structure, but again may be useable with other commercial, residential, municipal or industrial building structures such as a shop, home, garage, shed, gazebo, patio, lean-to, pavilion or the like. Such building may be temporary or permanent. The roof system of the present invention is highly configurable and adjustable.

The roof system 100 basically comprises at least one fixed beam 110, at least one set of movable, overlapping segments 120 communicatively, movably coupled to the fixed beam, and at least one header beam 130 to which the segments 120 are also communicatively, movably coupled. The beams 110 and 120 are shown connected to other building elements to form a building structure. The beams 110 and 120 preferably have roller tracks. The roof system 100 is shown to have two sets of segments 120, and permits each to include a different number or segments, different sized segments and segments which are arranged to have differing roof pitches. Each of these elements is preferably constructed of a strong, rigid material such as steel or another metal. In certain embodiments, the structures can use panel configurations, tracks, rollers, and convertible walls of the type disclosed in U.S. patent application Ser. No. 13/041,237, filed Mar. 4, 2011 and entitled Convertible Enclosure.

Although the structure and function of the system 100 and components thereof are disclosed as being deployed on a roof, it is within the purview of the invention that they may be deployed or integrated in a wall system with wall and/or window panels. As used herein, the phrase "generally parallel" means parallel, almost parallel, or having the general appearance of being parallel.

The descriptions above and the accompanying materials should be interpreted in the illustrative and not the limited sense. While the invention has been disclosed in connection with the preferred embodiment or embodiments thereof, it should be understood that there may be other embodiments which fall within the scope of the invention.

The invention claimed is:

1. A convertible structure comprising:

a fixed frame including an elongated first support positioned at a peak of the convertible structure and an elongated second support downwardly and laterally offset from the first support, the first and second supports having lengths that are generally parallel;

the convertible structure including first and second side wall regions positioned on opposite sides of the elongated first support, the second side wall region being positioned adjacent the elongated second support, the convertible structure also including a first roof region positioned between the elongated first support and the first side wall region, and the convertible structure further including a second roof region positioned between the elongated first support and the elongated second support;

a plurality of combined side wall and roof units each including a first side wall panel and a first roof panel which are integrated together so as to be movable together as a unit, the combined side wall and roof units being movable relative to one another along the length of the elongated first support between an extended configuration and a retracted configuration, the combined side wall and roof units enclosing the first side wall region and the first roof region when in the extended configuration, and the combined side wall and roof units substantially overlapping one another when in the retracted configuration such that the first side wall region and the first roof region are open;

a plurality of second roof panels that each span a distance between the first elongated support and the second elongated support, the second roof panels being movable relative to one another along the lengths of the elongated first and second supports between an extended configuration and a retracted configuration, the second roof panels being movable between the extended and retracted configurations independent of the combined side wall and roof units, the second roof panels enclosing the second roof region when in the extended configuration, and the second roof panels substantially overlapping one another when in the retracted configuration such that the second roof region is open; and a plurality of second wall panels mounted beneath the second elongated support, the second wall panels being movable relative to one another along the length of the elongated second support between an extended configuration and a retracted configuration, the second wall panels being movable between the extended and retracted configurations independent of the second roof panels, the second wall panels enclosing the second side wall region when in the extended configuration, and the second wall panels substantially overlapping one another when in the retracted configuration such that the second side wall region is open.

2. The convertible structure of claim 1, wherein the elongated first support and the elongated second support include horizontal beams having ends supported by vertical posts.

3. The convertible structure of claim 2, wherein at least some of the posts are supported on vertically adjustable footings.

4. The convertible structure of claim 3, wherein the vertically adjustable footings include screws for adjusting support heights of the footings.

5. A convertible structure comprising:

a fixed frame including an elongated first support positioned at a peak of the convertible structure and an elongated second support downwardly and laterally offset from the first support, the first and second supports having first dimensions that are generally parallel;

the convertible structure including first and second side wall regions positioned on opposite sides of the elongated first support, the second side wall region being positioned adjacent the elongated second support, the convertible structure also including a first roof region positioned between the elongated first support and the first side wall region, and the convertible structure further including a second roof region positioned between the elongated first support and the elongated second support;

a plurality of combined side wall and roof units each including a first side wall panel and a first roof panel which are integrated together so as to be movable together as a unit, the combined side wall and roof units being movable relative to one another along the first dimension of the elongated first support between an extended configuration and a retracted configuration, the combined side wall and roof units enclosing the first side wall region and the first roof region when in the extended configuration, and the first side wall region and the first roof region being open when in the retracted configuration;

a plurality of second roof panels that each span a distance between the first elongated support and the second elongated support, the second roof panels being movable relative to one another along the first dimensions of the elongated first and second supports between an extended configuration and a retracted configuration, the second roof panels being movable between the extended and retracted configurations independent of the combined side wall and roof units, the second roof panels enclosing the second roof region when in the extended configuration, and the second roof region being open when in the retracted configuration; and a plurality of second wall panels mounted beneath the second elongated support, the second wall panels being movable relative to one another along the first dimension of the elongated second support between an extended configuration and a retracted configuration, the second wall panels being movable between the extended and retracted configurations independent of the second roof panels, the second wall panels enclosing the second side wall region when in the extended configuration, and the second side wall region being open when in the retracted configuration.

6. The convertible structure of claim 5, wherein the elongated first support and the elongated second support include horizontal beams having ends supported by vertical posts.

7. The convertible structure of claim 6, wherein at least some of the posts are supported on vertically adjustable footings.

8. The convertible structure of claim 7, wherein the vertically adjustable footings include screws for adjusting support heights of the footings.

* * * * *